US007261516B2

(12) United States Patent
Liang et al.

(10) Patent No.: US 7,261,516 B2
(45) Date of Patent: Aug. 28, 2007

(54) FAN HOLDER ASSEMBLY

(75) Inventors: Chun-Chi Liang, Shenzhen (CN); Ji-Guo Xu, Shenzhen (CN); Hsuan-Tsung Chen, Shenzhen (CN); Xiang-Yu Xiao, Shenzhen (CN)

(73) Assignees: Hong Fu Jin Precision Industry (Shen Zhen) Co., Ltd., Longhua Town, Bao'an District, Shenzhen City, Guangdong Province (CN); Hon Hai Precision Industry Co., Ltd., Tu-Cheng City, Taipei Hsien (TW)

( * ) Notice: Subject to any disclaimer, the term of this patent is extended or adjusted under 35 U.S.C. 154(b) by 0 days.

(21) Appl. No.: 11/306,451

(22) Filed: Dec. 29, 2005

(65) Prior Publication Data

US 2007/0009356 A1 Jan. 11, 2007

(30) Foreign Application Priority Data

Jul. 9, 2005 (CN) ..... 2005 1 0035921

(51) Int. Cl.
*F04D 29/64* (2006.01)

(52) U.S. Cl. ..... 415/213.1; 415/214.1; 415/220; 415/223; 361/687; 361/695; 454/184

(58) Field of Classification Search ..... 415/213.1, 415/214.1, 220, 223; 361/687, 695, 697; 454/184

See application file for complete search history.

(56) References Cited

U.S. PATENT DOCUMENTS

| | | | | |
|---|---|---|---|---|
| 5,788,566 | A * | 8/1998 | McAnally et al. | 454/184 |
| 6,137,681 | A | 10/2000 | Lu | |
| 6,215,659 | B1 * | 4/2001 | Chen | 361/695 |
| 6,464,578 | B1 * | 10/2002 | Chin et al. | 454/184 |
| 6,711,015 | B2 * | 3/2004 | Syring et al. | 361/695 |
| 6,817,939 | B2 * | 11/2004 | Gan et al. | 454/184 |
| 7,038,913 | B2 * | 5/2006 | Lee et al. | 361/687 |
| 2003/0228840 | A1 * | 12/2003 | Gough et al. | 454/184 |

* cited by examiner

*Primary Examiner*—Christopher Verdier
(74) *Attorney, Agent, or Firm*—Winston Hsu

(57) ABSTRACT

A fan holder assembly includes a fan duct, a fan, and a holder that secures the fan to the fan duct. The holder is a frame and defines an air hole in the center thereof. Four through holes are defined in the edge of the holder for securing the holder to the fan duct, and a hook is formed from the edge of the air hole for securing the fan to the fan holder. Via this assembly, the fan duct is capable of selectively engaging with different sizes of fans to satisfy the need of cooling.

16 Claims, 4 Drawing Sheets

FAN HOLDER ASSEMBLY

FIELD OF THE INVENTION

The present invention relates to a fan holder assembly, and particularly to a fan holder assembly which can fix two fans of different sizes in a computer.

DESCRIPTION OF RELATED ART

A typical contemporary personal computer includes a central processing unit (CPU) and a power supply. Heat is generated by the CPU, and the heated air is removed away from the CPU by a fan driven by the power supply. However, a single fan does not always effectively dissipate large amounts of heated air generated from contemporary powerful CPUs. Accordingly, a fan duct with a fan is needed.

Typically, the size of a fan is determined by the size of the fan duct which the fan is attached to. One fan duct fixes only fans of one size. Referring to FIG. 4, a fan holder assembly, includes a fan duct 60, and a larger-size fan 80 which fits the fan duct 60. The fan duct 60 defines four screw holes 62 therein, and the fan 80 defines a mounting hole 82 in each corner thereof. The fan 80 is mounted in the fan duct 60 with four screws 70 extending through the mounting holes 82 and engaging in the screw holes 62.

What is needed is a fan holder assembly which is capable of selectively engaging with fans of different sizes to satisfy the different needs of cooling.

SUMMARY OF INVENTION

In one preferred embodiment, a fan holder assembly includes a fan duct, a fan, and a holder fastened to the fan duct. The holder is a frame and defines an air hole in the center thereof. A first locking means is formed at an outer portion of the holder for fastening the holder to the fan duct, and a second locking means is formed around the air hole for fastening the fan to the holder.

Other advantages and novel features will become more apparent from the following detailed description of preferred embodiments when taken in conjunction with the accompanying drawings, in which:

DETAILED DESCRIPTION

Figure 1:
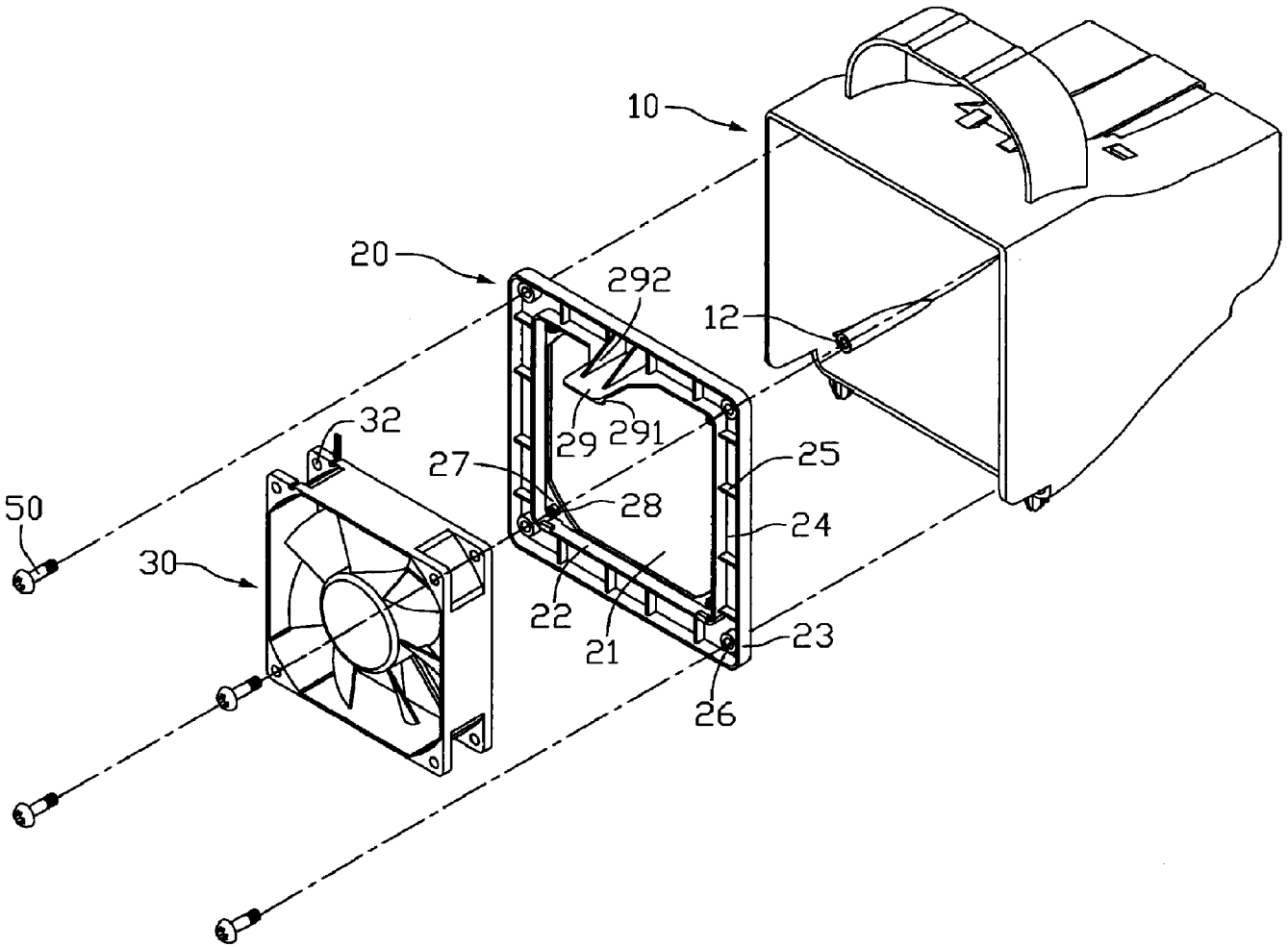
FIG. 1 is an exploded, isometric view of a fan holder assembly in accordance with a first preferred embodiment of the present invention.
Figure 4:
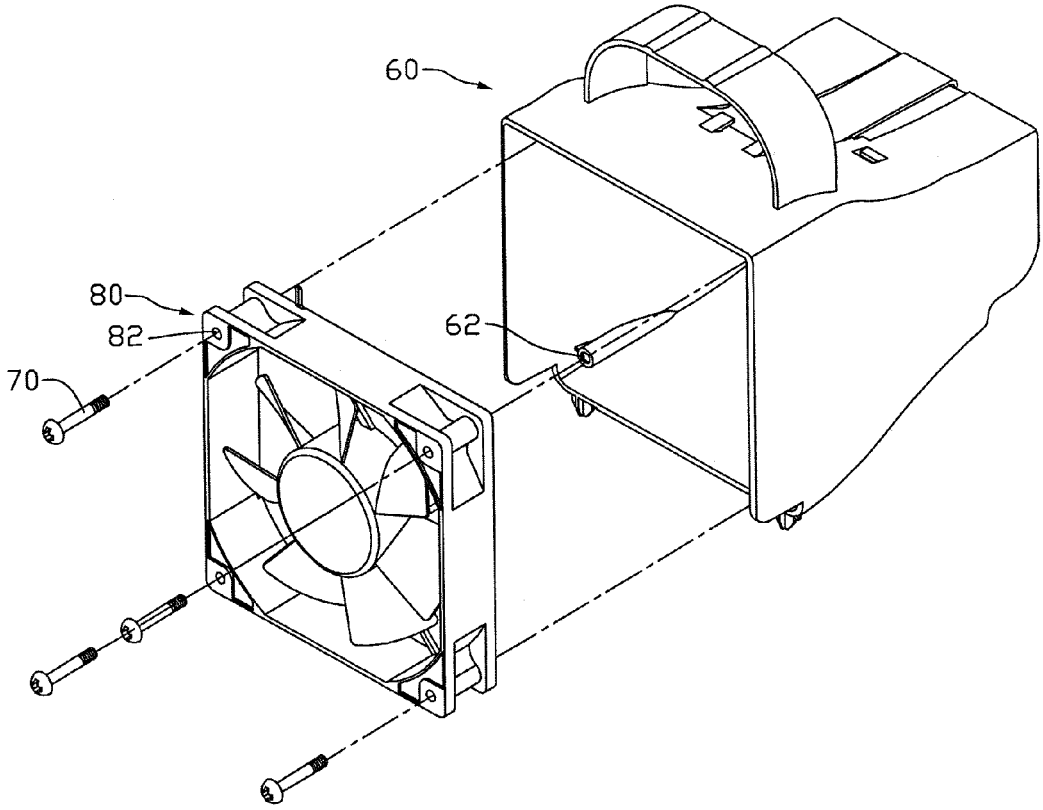
FIG. 4 (PRIOR ART)
FIG. 4 is an exploded, isometric view of a conventional fan holder assembly.

Referring to FIG. 1, a fan holder assembly in accordance with a first preferred embodiment of the present invention, includes a fan duct 10, a holder 20 mounted in the fan duct 10 and a smaller-size fan 30. A larger-size fan can be mounted in the fan duct 10 straight (referring to FIG. 4). The fan duct 10 defines a screw hole 12 in each of the corners thereof.

The holder 20 is a frame and defines an air hole 21 in the center thereof. The holder 20 forms an inner flange 22 around the air hole 21, and an outer flange 23. An annular trough 24 is formed between the inner flange 22 and the outer flange 23. A plurality of ribs 25 is formed in the annular trough 24. The annular trough 24 forms a first locking means at the four corners thereof, and the first locking means includes four through holes 26 in this preferred embodiment. The inner flange 22 forms a baffle 27 at each corner thereof. The baffles 27 and the inner flange 22 corporately make up of a fan mounting area. A mounting rod 28 is formed from each baffle 27. One side of the inner flange 22 protrudes and forms a second locking means. The second locking means is a hook 29 in this preferred embodiment. A wedge 291 extends inward from a distal end of the hook 29. Two ribs 292 are formed at an outer side of the hook 29.

The fan 30 has a dimension smaller than that of the fan duct 10. The fan 30 defines a mounting hole 32 in each corner thereof.

Figure 2:
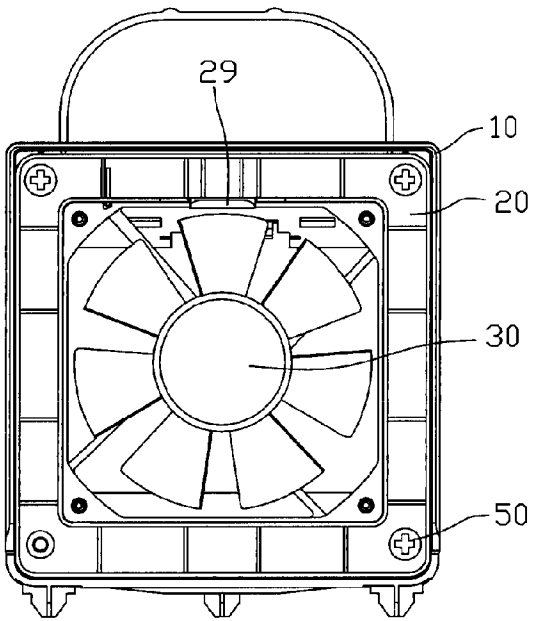
FIG. 2 is an assembled, front plan view of FIG. 1.

Referring also to FIG. 2, in assembly, four screws 50 extend through the through holes 26 of the holder 20, and engage into the screw holes 12 of the fan duct 10. Thus, the holder 20 is fastened to the fan duct 10, with the outer flange 23 abutting against the inside of the fan duct 10. The fan 30 is disposed in the fan mounting area, with the outside of the fan 30 abutting against the inner flange 22 of the holder 20. The mounting rods 28 of the holder 20 are inset into the mounting holes 32 of the fan 30 so as to limit the fan 30. The fan 30 is locked in the mounting area by the wedge 291 of the hook 29 engaging with an edge of fan 30. Thus, the fan 30 is fastened to the fan duct 10 by using the holder 20.

When the fan 30 is not capable of satisfying the need of cooling, the larger-size fan is fastened to the fan duct 10 straight instead of the fan 30 and the holder 20.

Figure 3:
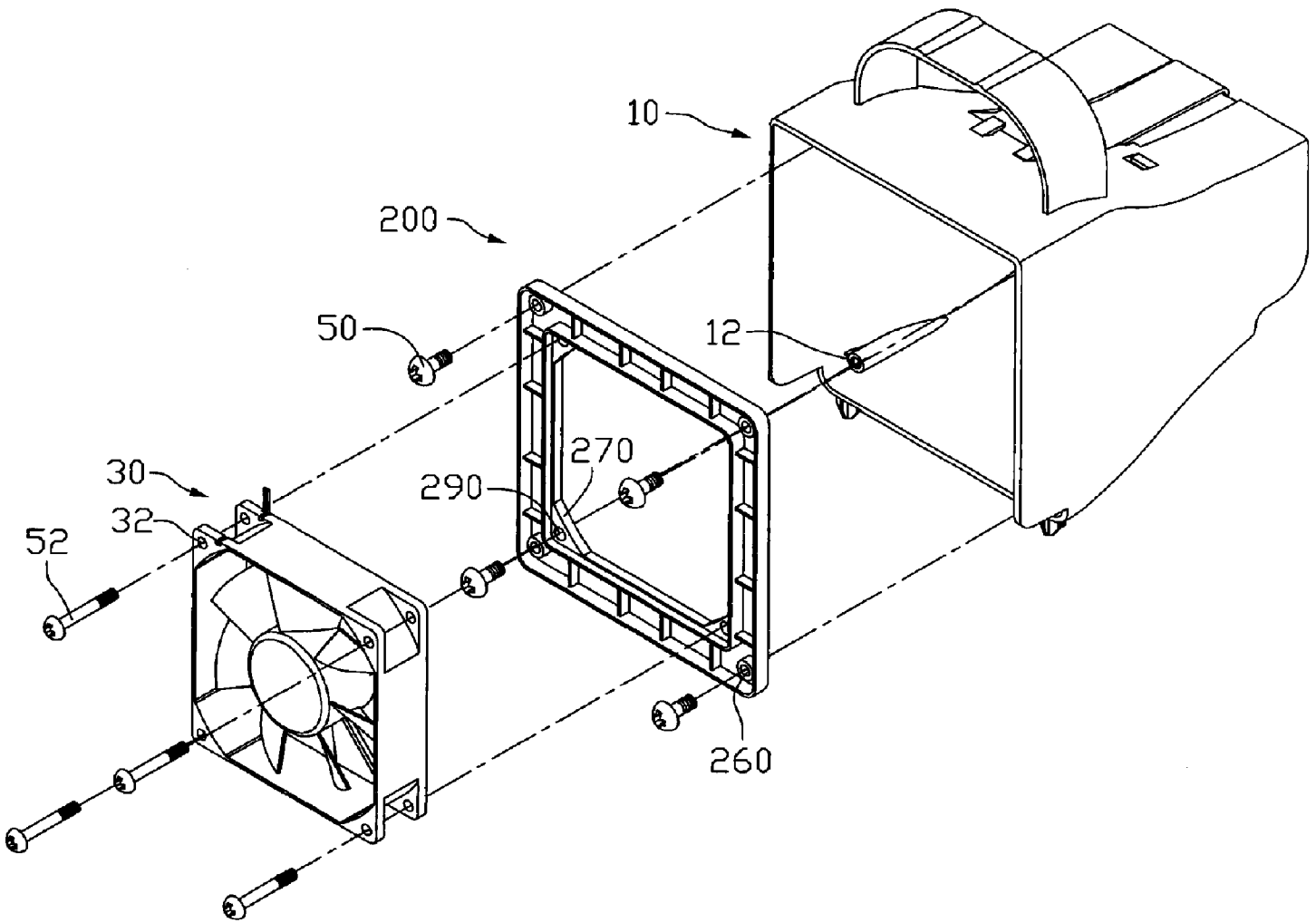
FIG. 3 is an exploded, isometric view of a fan holder assembly in accordance with a second preferred embodiment of the present invention.

Referring to FIG. 3, a fan holder assembly in accordance with a second embodiment of the present invention, includes a fan duct 10, a holder 200 fastened in the fan duct 10, and a fan 30. The differences between the second embodiment and the first embodiment are: the second locking means of the holder 200 is four screw holes 290 defined in the baffles 270. Four screws 52 extend through the mounting holes 32 of the fan 30, and then engage into the screw holes 290.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments.

What is claimed is:

1. A fan holder assembly, comprising:

a fan duct;

a fan comprising a plurality of mounting holes defined in corners of the fan; and a holder fastened to the fan duct, wherein the holder comprises a frame and the frame defines an air hole in the center of the frame, the frame comprises an inner flange surrounding the air hole, and an outer flange spaced from and surrounding the inner flange, a trough being formed between the inner and outer flanges in a radial direction of the air hole, a plurality of baffles extending from the inner flange into the air hole to block a first end surface of the fan;

wherein the outer flange of the holder abuts against an inner surface of the fan duct in the radial direction of the air hole, and the inner flange of the holder surrounds and abuts against the periphery of the fan in the radial direction of the air hole.

2. The fan holder assembly as claimed in claim 1, wherein a mounting rod is formed from each of the baffles for engaging in a corresponding one of the mounting holes of the fan, and a hook extends from the frame along an axis of the air hole for hooking the fan.

3. The fan holder assembly as claimed in claim 2, wherein a wedge extends inward from a distal end of the hook to ride over the fan and hook a second end surface of the fan opposite to the first end surface, and a plurality of reinforcing ribs is formed at an outer side of the hook.

4. The fan holder assembly as claimed in claim 1, wherein a plurality of ribs is formed in the trough for connecting the inner and outer flanges.

5. A fan holder assembly, comprising:

a fan duct, having a plurality of screw holes, which is suitable for locking a first size fan in the fan duct; and a holder comprising an air hole, an inner flange surrounding the air hole, and an outer flange spaced from and surrounding the inner flange, a plurality of baffles extending from the inner flange into the air hole to block a first end surface of a second size fan;

wherein the holder defines a plurality of through holes for fastening the holder to the fan duct via a plurality of screws extending through the through holes and engaging into the screw holes of the fan duct;

wherein the outer flange of the holder abuts against an inner surface of the fan duct in the radial direction of the air hole, and the inner flange of the holder surrounds and abuts against the periphery of the fan in the radial direction of the air hole.

6. The fan holder assembly as claimed in claim 5, wherein the inner flange of the holder abuts against an outer surface of the second size fan in the radial direction of the air hole.

7. The fan holder assembly as claimed along claim 6, wherein a hook extends from the holder in an axis of the air hole, a wedge extends inward from a distal end of the hook to ride over the outer surface of the second size fan and hook a second end surface of the second size fan opposite to the first end surface.

8. The fan holder assembly as claimed in claim 7, wherein a plurality of reinforcing ribs is formed at an outer side of a base of the hook.

9. The fan holder assembly as claimed in claim 5, wherein a mounting rod is formed on each of the baffles for engaging in a respective mounting hole defined in a respective corner of the second size fan.

10. A fan holder assembly, comprising:

a fan duct comprising a wall surrounding an air inlet, the wall having an inner surface communicating with the air inlet, the wall extending along an axis of the air inlet, a plurality of screw holes, which is suitable for locking a first size fan in the fan duct, being defined in corners of the air inlet; and a holder which is capable of locking a second size fan thereto comprising an air hole, an inner flange extending from a circumference of the air hole along the axis of the air inlet, and an outer flange spaced from and around the inner flange, a plurality baffles extending from the inner flange into the air hole to block an end surface of the second size fan, a plurality of through holes defined in an area between the inner and outer flanges, for screws extending through the through holes and engaging in the screw holes of the fan duct.

11. The fan holder assembly as claimed in claim 10, wherein a mounting rod is formed from each of the baffles for engaging in a respective mounting hole defined in a respective corner of the second size fan.

12. The fan holder assembly as claimed in claim 10, wherein a hook is formed from an edge of the inner flange.

13. The fan holder assembly as claimed in claim 12, wherein a wedge extends inward from a distal end of the hook to ride over the outer surface of the second size fan and hook a second end surface of the second fan opposite to a first end surface of the second size fan, and a plurality of reinforcing ribs is formed at an outer side of a base of the hook.

14. The fan holder assembly as claimed in claim 10, wherein a trough is formed between the inner and outer flanges.

15. The fan holder assembly as claimed in claim 14, wherein a plurality of ribs is formed in the trough for connecting the inner and outer flanges.

16. The fan holder assembly as claimed in claim 10, wherein the outer flange of the holder abuts against the inner surface of the fan duct, and the inner flange of the holder abuts against an outer peripheral surface of the second size fan in a direction perpendicular to the axis of the air inlet.

* * * * *